US007204052B2

(12) United States Patent
Swan

(10) Patent No.: US 7,204,052 B2
(45) Date of Patent: Apr. 17, 2007

(54) DETACHABLE MOUNT FOR A TELESCOPIC FIREARM SIGHT

(76) Inventor: Richard E. Swan, 230 West St., West Bridgewater, MA (US) 02379

( * ) Notice: Subject to any disclaimer, the term of this patent is extended or adjusted under 35 U.S.C. 154(b) by 31 days.

(21) Appl. No.: 11/036,069

(22) Filed: Jan. 14, 2005

(65) Prior Publication Data

US 2005/0241212 A1 Nov. 3, 2005

Related U.S. Application Data

(60) Provisional application No. 60/538,954, filed on Jan. 23, 2004.

(51) Int. Cl.
*F41G 1/387* (2006.01)

(52) U.S. Cl. ..... 42/127; 42/147

(58) Field of Classification Search ..... 42/127, 42/119, 124, 148
See application file for complete search history.

(56) References Cited

U.S. PATENT DOCUMENTS

| | | | | | |
|---|---|---|---|---|---|
| 2,365,976 | A | | 12/1944 | Sorensen | 33/50 |
| 2,526,816 | A | | 10/1950 | Hardgrove | 33/50 |
| 2,528,080 | A | * | 10/1950 | Robertson | 42/127 |
| 2,580,246 | A | | 12/1951 | Schall | 33/50 |
| 2,585,985 | A | | 2/1952 | Anderson | 33/50 |
| 2,924,881 | A | | 2/1960 | Gee | 33/50 |
| 2,931,101 | A | | 4/1960 | Martin | 33/50 |
| 3,365,801 | A | | 1/1968 | DeSimone, Jr. | 33/50 |
| 3,414,221 | A | * | 12/1968 | Nelson | 42/126 |
| 3,579,840 | A | | 5/1971 | Heinzel | 33/50 |
| 3,835,565 | A | * | 9/1974 | Weast | 42/90 |
| 3,877,166 | A | | 4/1975 | Ward | 42/1 S |
| 3,880,389 | A | | 4/1975 | Burris | 248/205 R |
| 4,341,022 | A | | 7/1982 | Santoro | 33/245 |
| 4,703,576 | A | * | 11/1987 | Burris | 42/125 |
| 4,959,908 | A | * | 10/1990 | Weyrauch | 42/124 |
| 5,144,752 | A | * | 9/1992 | Boeke et al. | 42/126 |
| 5,355,607 | A | | 10/1994 | Klotz | 42/101 |
| 5,533,267 | A | * | 7/1996 | Haight, Jr. | 42/124 |
| 5,787,630 | A | * | 8/1998 | Martel | 42/125 |
| 6,026,580 | A | | 2/2000 | LaRue | 33/250 |
| 6,418,657 | B1 | | 7/2002 | Brown | 42/124 |
| 6,594,938 | B2 | | 7/2003 | Horton | 42/127 |
| 2003/0154641 | A1 | | 8/2003 | Stover | 42/124 |
| 2003/0192224 | A1 | | 10/2003 | Kirk | 42/124 |
| 2004/0016169 | A1 | | 1/2004 | Poff, Jr. | 42/124 |

* cited by examiner

*Primary Examiner*—Stephen M. Johnson
*Assistant Examiner*—Bret Hayes
(74) *Attorney, Agent, or Firm*—Barlow, Josephs & Holmes, Ltd.

(57) ABSTRACT

A positively aligning, quick mount assembly for interfacing an auxiliary sighting device such as an optical scope with a firearm is disclosed. The positive-aligning quick mount device includes a sight receiver that is attached to a firearm utilizing a firearm interface and includes a mounting ring that supports the sighting device and is configured to be received and retained by the sight receiver. It is further designed to allow quick and easy mounting, removal and re-mounting of auxiliary sights on any firearm while eliminating the need to re-adjust or zero the scope when it is replaced in its mounted position on the firearm.

19 Claims, 6 Drawing Sheets

DETACHABLE MOUNT FOR A TELESCOPIC FIREARM SIGHT

CROSS-REFERENCE TO RELATED APPLICATIONS

This application is related to and claims priority from earlier filed U.S. Provisional Patent Application No. 60/538,954, filed Jan. 23, 2004, the contents of which are incorporated herein by reference.

BACKGROUND OF THE INVENTION

The present invention relates generally to a telescopic sight mount for firearms. More specifically, the present invention is related to a detachable mount for a telescopic sight that allows the user to easily interchange or remove and store the sighting device utilized on the firearm while also providing quick and positive alignment of the sighting device when repositioning the device on the firearm.

In the prior art, auxiliary sighting devices are typically rigidly mounted onto the top of the firearm receiver. Generally, these prior art firearms, such as rifles, shotguns, black-powder weapons and handguns, typically include spaced apart attachment points located on the top surface of the receiver, which are used for attaching an auxiliary device such as a sighting scope. Such sight attachment points serve to position and secure the auxiliary sighting device above the barrel of the firearm and roughly align the sighting device with the barrel of the firearm. The scope is then adjusted so that it is more precisely sighted relative to the firearm to provide an accurate and positive alignment between the aiming point of the sight and the barrel of the firearm.

There are numerous different types and configurations of scope mounting devices known in the prior art, each of which includes its own design problems and disadvantages. Generally, these prior art mounting devices typically encompass and hold a sighting scope within in a scope holding portion which is then attached to a base, which is in turn mounted onto the attachment points on the receiver of a firearm. The standard and most widely used method for mounting scopes on firearms includes a combination of a scope base and scope rings. The scope base is a platform that is securely attached to the firearm to provide a mounting platform that is configured to receive the rings. The rings are typically formed as individual, horizontally split cylindrical clamps that are placed around the scope body or "tube" and fastened in place. The rings also include lower mounting portions that then allow the rings, with the scope mounted therein, to be secured to the base either permanently or in removable engagement. These types of mounting devices are generally mounted using a variety of screw fasteners requiring the use of a tool, such as a screwdriver or Allen wrench, to firmly seat and retain the scope holding portion on the base or to remove the scope holding portion from the base. Thus, it is often difficult and time consuming to attach and/or remove the scope from the base.

Additionally, there are many different scope ring/base combinations that are available in the prior art. One popular style known to those skilled in the art is the "Weaver" system, which utilizes longitudinal rail-type bases that are mounted onto the upper receiver of the firearm of formed integrally thereon. The rings wrap around the barrel of the scope and are transversely clamped to the rails. Another mounting configuration is the popular "rotary dovetail" style in which a base is provided with a ring-receiving slot, a mating dovetail portion of the scope ring is dropped into the slot and the ring is rotated 90° into locking alignment with the receiver and barrel. Yet another style is the "Ruger® dovetail" system in which a dovetail "base" is actually machined into the firearm's receiver, and specially mated rings are clamped on with heavy screws.

Recently, AR-15 type rifles and their military M-16 counterparts have been manufactured with a receiver rail configuration in which the carrying handle is removed (or is removable), and the upper receiver surface is machined into a flat, Weaver style scope base configuration in order to accept different types of mounts or rings. The Weaver style configuration is common in the flattop design because many military scope systems are adapted for Weaver type mounts, and because the long flattop base allows the mounting of scopes and a variety of other accessories having different lengths. In connection with the Weaver type system, a "quick release" concept in which the rings, with the scope mounted therein, can be mounted and dismounted without tools, or with simple tools, and quickly reattached without the need for re-zeroing the scope.

All of the foregoing systems have drawbacks or disadvantages fundamental to traditional ring mount systems. One problem is the need for rings of different heights to mount scopes with different objective lens diameters on the same firearm. For example, a scope with a small objective lens diameter or "bell" (e.g., 20–32 mm lens) might be mounted to a rifle using "low" height ring mounts; a medium bell (e.g., 33–42 mm lens) might require "medium" height ring mounts for the same firearm; and, a large-belled scope (e.g., 44–56 mm lens) would require a "high" ring mount. There are also times when it may be desirable to adjust the mounting height of the scope for the sighting comfort of the shooter, or to allow sufficient clearance for backup use of the firearm's metallic sights that are located beneath the scope.

Another problem occurs during longitudinal adjustment of the scope relative to the base and the firearm. With prior art systems, the rings are fixed in place and the scope must be loosened from the rings enough for the scope to slide back and forth within the rings until proper eye relief is achieved. When the scope is loosened in this fashion, it is likely to be moved out of rotational alignment, i.e., where the crosshairs are no longer "square" to the receiver. This can result in a significant loss of accuracy for long range shooting. Further, once the crosshairs are moved out of alignment in this fashion, it is a time consuming task to re-align the crosshairs.

To further complicate the issue, firearms that are utilized in combat must be constructed to be relatively durable and capable of withstanding wide variations in atmospheric conditions and substantial physical shock. Telescopic sights, in contrast, are relatively delicate optical instruments that are vulnerable to variations in atmospheric conditions and to physical shock. A sharp blow to a telescopic sight will often shift its point of aim. As a result, firearms with permanently attached telescopic sights must be treated delicately.

It is desirable, therefore, to provide the ability to detach the telescopic sight until the user requires it. In this manner, the sight can be removed from the firearm when not needed tin order to protect the sight from rough handling and damage. One such type of detachable mount is disclosed in U.S. Pat. No. 5,035,487, issued to Herz. While this device is effective in allowing the sight to be removed from the firearm until needed, the Herz type of device is slow to operate. The user must hold the rifle securely while using his or her free hand to rotate the small levers employed to engage the scope mounts. Further, the levers do not provide much mechanical advantage and both of them must be rotated independently to the correct position. The telescopic sight must then be lifted off the mounting base without tilting; otherwise the device tends to become stuck. This is an undesirable drawback in combat situations where the telescopic sight must often be removed rapidly. This is particularly true when entering into a close combat situation. In such close range work, the use of the open (sometimes called "iron") sights on the rifle is generally preferred. Thus, a scope which could be removed quickly using a single reliable latching device is preferable.

There is therefore a need for a mounting system that allows the rapid mounting and removal of a telescopic sight from a firearm that is easy to utilize, resists jamming and reliably aligns the sight with the firearm when the sight is replaced in the mounting system. Further, there is a need for such a mounting system to interface with preexisting equipment for integration with a modular support system thereby allowing for easy mounting, removal and interchangeability.

BRIEF SUMMARY OF THE INVENTION

In this regard, the present invention provides for a positively aligning, quick mount assembly for interfacing an auxiliary sighting device such as an optical scope with a firearm. The mounting assembly is designed to be used with a variety of sighting scopes such as are used on prior art firearms including, shotguns, rifles, black-powder weapons, combat weaponry and handguns. The new and novel positive-aligning quick mount is further designed to allow quick and easy mounting, removal and re-mounting of auxiliary sights on any firearm while eliminating the need to re-adjust or zero the scope when it is replaced in its mounted position on the firearm. The present invention is particularly suited for use in the modern type sporting and/or combat rifle that includes some form of receiver rail mounting system formed on its upper receiver, in that the present invention is modularized in a manner that makes it particularly flexible and customizable for a variety of applications.

It should be appreciated that the term "scope" as used herein is to be understood as including all types of sighting devices capable of being mounted on a firearm, including but not limited to telescopic sights, optical sights, night vision devices, range finding and illuminating devices.

In particular the present invention provides a modular sight mounting system that allows easy removal and remounting of various sighting devices without the need for realigning the sight. The modular system includes three main components, the firearm interface, the sight receiver and the mounting ring. The firearm interface is configured to be mounted onto the firearm. In the preferred embodiment the firearm interface is mounted to a mounting rail that is either connected directly to the receiver of the firearm or is a component part to a receiver/barrel guard sleeve system. The firearm interface may include a gripping clamp that engages the sides of the rail to firmly hold the firearm interface to the fire arm. The firearm interface can be positioned in any location along the receiver and/or barrel of the firearm thereby providing for a large degree of longitudinal adjustment and positioning of the scope. The clamping mechanism in the firearm interface is operated by a single thumb lever and a cam lock assembly making removal and/or adjustment easy.

The sight receiver is an arm that is rigidly mounted onto the firearm interface using fasteners such as screws. The sight receiver serves as the interface between the firearm interface and the scope mounting ring. The sight receiver includes a mechanism that is operable to selectively retain or release the scope mounting ring thereby allowing the scope to be selectively removed from the fire arm. When mounted to the firearm interface spacers may be installed between the sight receiver and the firearm interface to adjust the height of the scope relative to the firearm. In this manner, the system can be configured to accommodate a variety of sight devices as well as to allow the scope to be positioned to avoid conflict with other accessories that may be mounted on the firearm.

The mounting ring is installed around the tubular body of the site that will be used with the firearm. The mounting ring includes a lug on the bottom thereof that is received into an opening in the sight receiver. Additionally, the opening in the sight receiver further may include a concentric shoulder area to engage a portion of the mounting ring itself. This engagement provides additional contact surface to ensure proper and consistent alignment of the scope with the firearm even if the scope is removed and reinstalled several times. The retention mechanism in the receiver is a round pin with a portion of its diameter cut away. In a first position the remaining portion of the pin is flush with the sides of the opening that accepts the lug on the mounting ring. Once the mounting ring is installed, the pin is rotated so that the round part of the pin engages a mating formation in the lug thereby firmly holding the mounting ring and scope on the sight receiver. Further a spring loaded pin is also provided that prevents accidental operation of the locking pin. While this locking mechanism is described as having specific structure, any appropriate device could be substituted and remain within the scope of the present invention.

It is therefore an object of the present invention to provide a mounting system that allows easy removal and remounting of an auxiliary sight for use in conjunction with a firearm. It is a further object of the present invention to provide a mounting system that enhances the manner in which an auxiliary sighting device is interfaced with a firearm wherein the sighting device can be removed and replaced onto the firearm without the need to realign the sighting device. It is yet a further object of the present invention to provide a mounting system that includes a modular interface on the base thereof for interfacing with the variety of standard receiver rail assemblies in the prior art while including an means wherein an auxiliary sighting device can be removed and replaced onto the firearm without the need to realign the sighting device interface. It yet another object of the present invention to provide a modular auxiliary sight mounting system that allows a variety of different sized and shaped auxiliary sights to be quickly, reliably and easily removed and remounted onto a firearm.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 1:
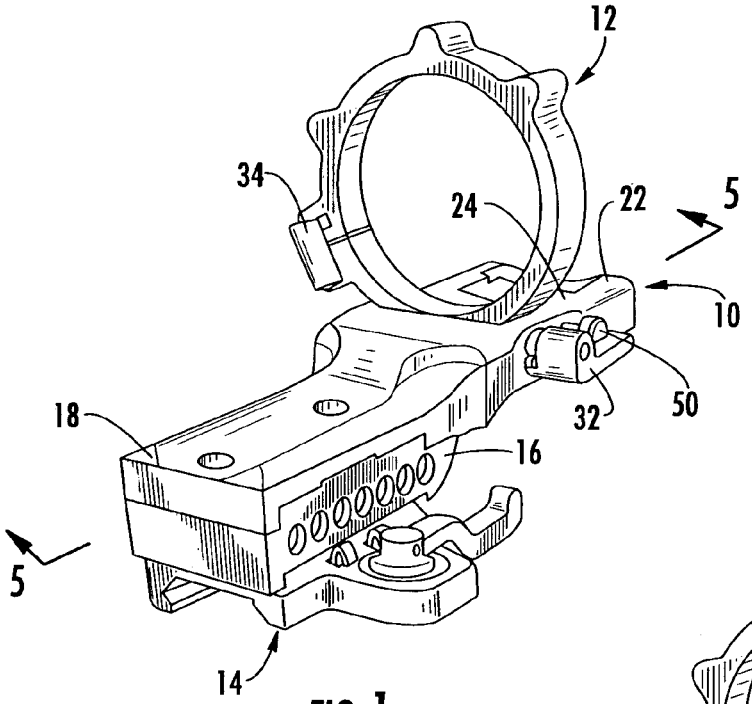
FIG. 1 is a rear perspective view of the sight mounting system of the present invention.

Now referring to the drawings, the sight mounting assembly of the present invention is shown and generally illustrated in the figures. While the assembly may include several components and auxiliary attachments to tailor the assembly for the particular application, in the simplest form, the present invention provides for a positively aligning, quick mount assembly for interfacing an auxiliary sighting device such as an optical scope with a firearm. In the preferred embodiment, the required components include at least a sight receiver 10 and a mounting ring 12. Additionally, other components that may be utilized in the assembly as required by the particular application include a firearm interface 14 that may simply be screws or a modular mounting base and one or more spacer blocks 16.

As was stated above, the auxiliary sight mounting assembly is designed to be used with a variety of sighting scopes such as the type typically used on any variety of prior art firearms including, shotguns, rifles, black-powder weapons, combat weaponry and handguns. Further, the terms "scope" or "sight" as used herein is to be understood as including all types of auxiliary sighting devices capable of being mounted on a firearm that are utilized in place of the standard iron sights already found on the firearm as manufactured, including but not limited to telescopic sights, optical sights, night vision devices, range finding and illuminating devices.

The principal objective of the auxiliary sight mounting assembly of the present invention the provision of a positively aligning quick mount that is designed to allow quick and easy mounting, removal and re-mounting of auxiliary sights on any firearm while eliminating the need to re-adjust or zero the scope when it is replaced in its mounted position on the firearm. This is an important feature because as was stated above, while a firearm can endure rough handling, auxiliary sighting devices generally cannot. The present invention also includes auxiliary features as will be further described below that make it particularly suited for use in the modern type sporting and/or combat rifle that includes some form of receiver rail mounting system formed on its upper receiver, in that the present invention includes accessories that are modularized in a manner that makes it particularly flexible and customizable for a variety of applications.

Figure 2:
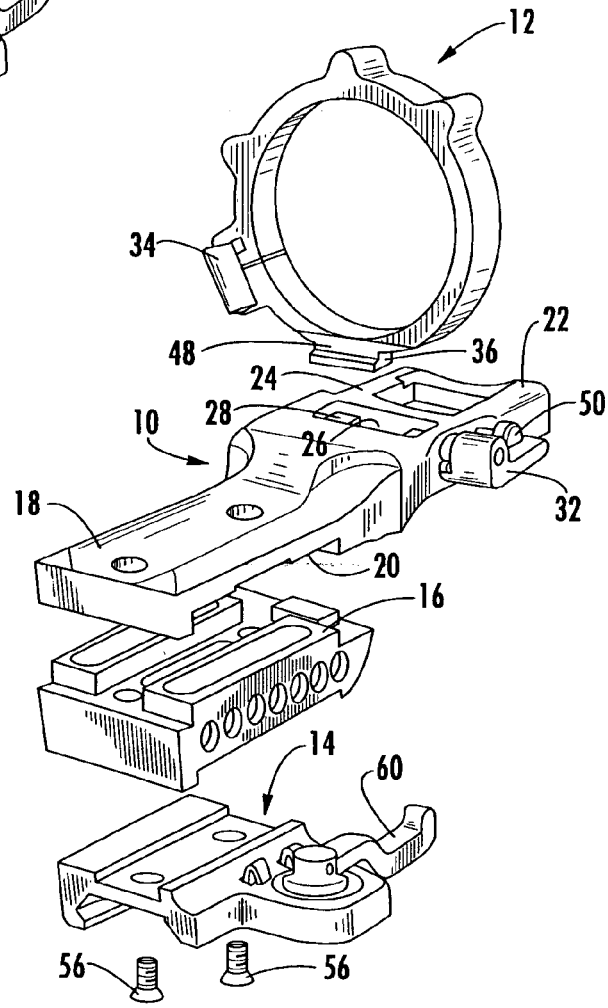
FIG. 2 is a rear, exploded perspective view of the sight mounting system of the present invention.

Turning to FIGS. 1 and 2, the auxiliary sight mounting system as stated above includes two main components, a sight receiver 10 and a mounting ring 12. The sight receiver 10 serves as the platform to which the mounting ring 12 is attached. A firearm interface 14 is in turn utilized to interface the sight receiver 10 with a firearm. Further, the firearm interface 14 may take the form of a mounting base as is shown in FIGS. 1 and 2 that serves as the firearm interface 14 to provide a modular interface, in a manner that will be more fully described below, between the sight receiver 10 and the firearm depending on the type of firearm that the sight mounting assembly will be utilized with. Additionally, should the positioning of the sight receiver 10 need to be adjusted to provide the correct the sight distance from the firearm, one or more modular spacer blocks 16 may be introduced between the sight receiver 10 and the fire arm or between the sight receiver 10 and the firearm interface 14.

The sight receiver 10 for the auxiliary sight mounting system of the present invention is formed to have a lower interface 18 and an upper interface 22. The lower interface 18 is configured to provide connectivity between the sight receiver 10 and the firearm. The lower surface 20 of the lower interface 18 is configured to interface with and facilitate its attachment to a firearm via a firearm interface 14. The lower interface 18 is preferably integrally formed with the upper interface 22 wherein the upper interface 22 includes an upper surface 24 and a mounting system. The mounting system includes a mounting slot 26, an alignment channel 28, a mounting pin 30 and an actuator 32 that all interact to retain the mounting ring 12 in an engaged position relative to the sight receiver 10 as will be described in detail below. The upper interface 22 may be offset relative to the plane of the lower interface 18 to provide additional clearance for operation of a scope when the scope is mounted onto the upper interface 22.

The mounting ring 12 is a substantially circular band that has a central opening therein to receive and retain an auxiliary sight. The mounting ring 12 includes a clamping assembly 34 that allows the mounting ring 12 to be slightly opened in order to receive the central tube of an auxiliary sight. Once the auxiliary sight is received in the mounting ring 12, the clamping assembly 34 is tightened to firmly fasten the mounting ring 12 around the outer surface of the auxiliary sight maintaining the sight and the mounting ring 12 in fixed relation to one another. The mounting ring 12 further includes a lug 36 thereon that serves as the structure by which the mounting ring 12 is fastened to the sight receiver 10 and retained therein as will be described below.

Figure 3:
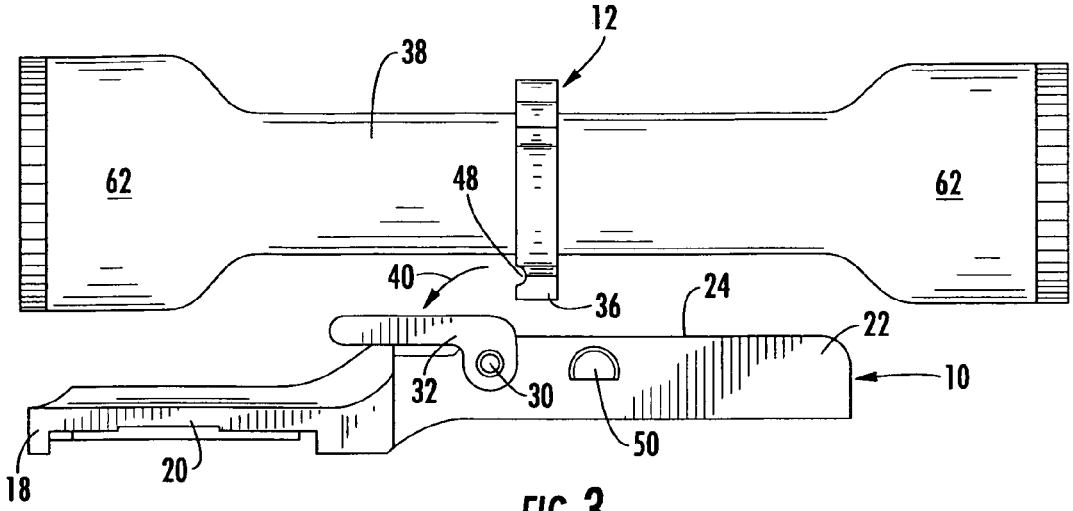
FIG. 3 is a side view of the sight mounting system of the present invention, with mounting ring and sight removed.
Figure 3A:
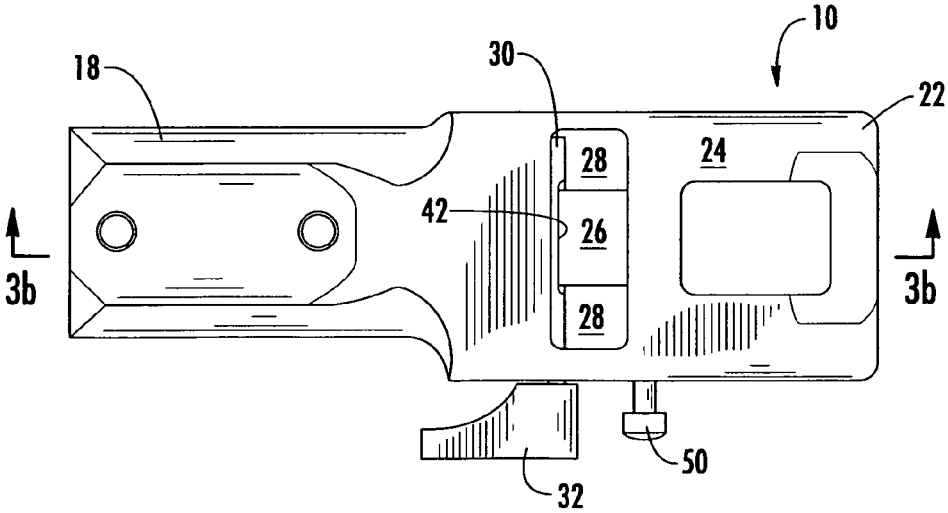
FIG. 3*a* is a top view of the sight mounting system of the present invention, with mounting ring and sight removed.
Figure 3B:
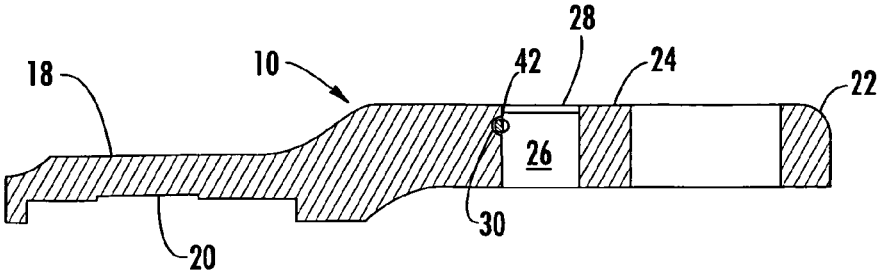
FIG. 3*b* is a cross sectional view of the sight mounting system of the present invention, taken along line 3*b*—3*b* in FIG. 3*a;*
Figure 4:
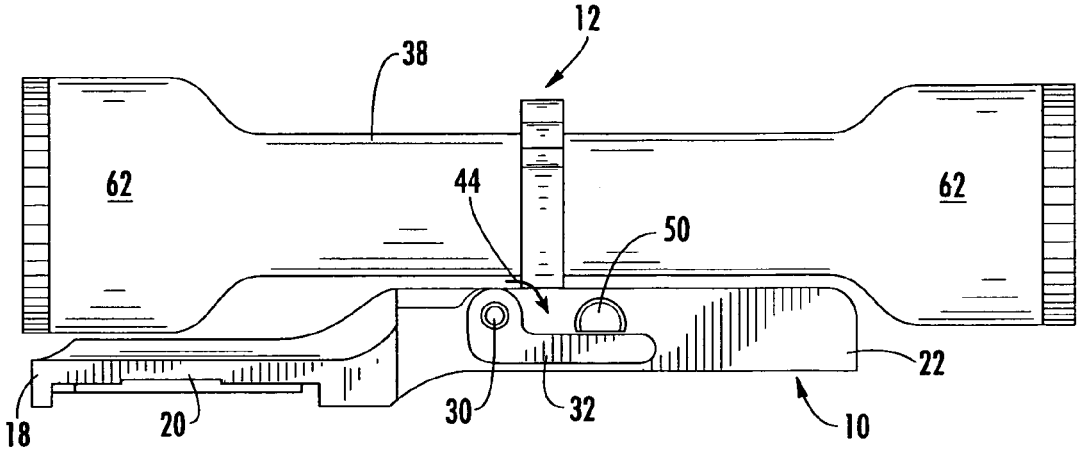
FIG. 4 is a side view of the sight mounting system of the present invention, with mounting ring and sight attached.
Figure 4A:
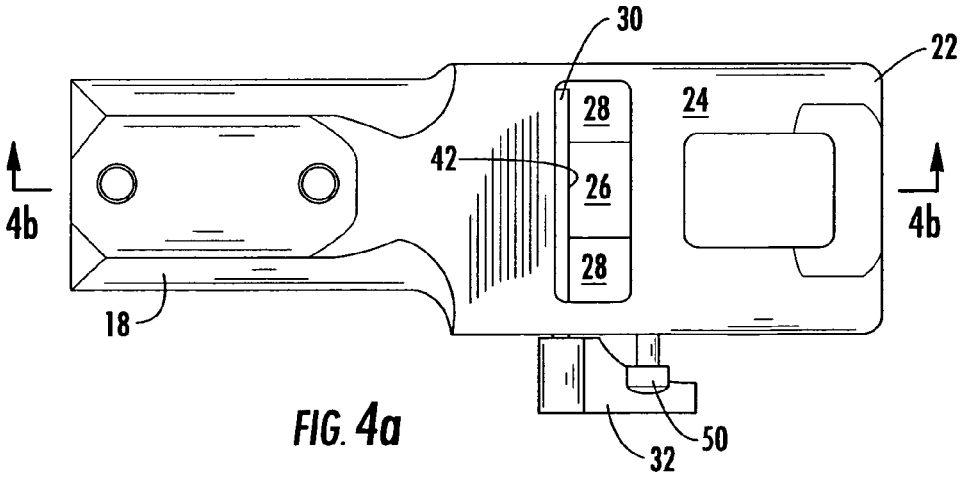
FIG. 4*a* is a top view of the sight mounting system of the present invention, with the retaining member in an engaged position, the mounting ring and sight are removed for clarity.
Figure 4B:
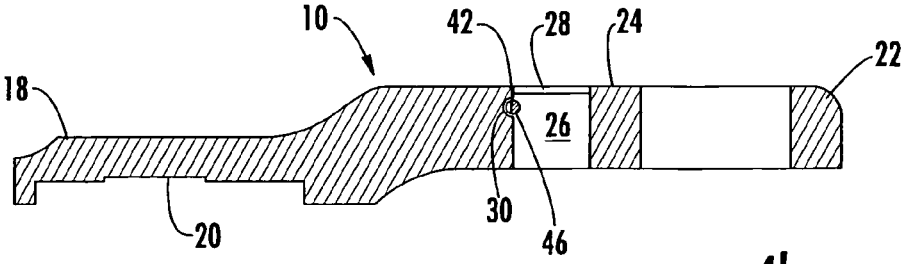
FIG. 4*b* is a cross sectional view of the sight mounting system of the present invention, taken along line 4*b*—4*b* in FIG. 4*a*, with the retaining member in an engaged position, the mounting ring and sight are removed for clarity.

Turning now to FIGS. 3–4*b*, the operational relationship between the mounting ring 12 and sight receiver 10 is generally shown and detailed. FIG. 3 shows an auxiliary sight 38 mounted into the mounting ring 12 and the sight 38 and mounting ring 12 are in an unattached position relative to the sight receiver 10. In this position the actuator arm 32 is shown to be rotated rearwardly as indicated by the arrow 40. The effect of rotating the actuator arm 32 rearwardly is clearly illustrated in the top view shown in FIG. 3*a* and the cross sectional view shown in FIG. 3*b*. In the top view, the upper interface 22 can be seen to include a mounting slot 26 extending therethrough. The mounting slot 26 is sized and shaped to be only slightly larger than the size and shape of the lug 36 on the mounting ring 12. Further, adjacent the mounting slot 26 is an alignment channel 28 that only extends partially into the surface of the upper interface 22 of the sight receiver 10. Also, in this view it can be seen that the actuator arm 32 is attached to one end of the mounting pin 30 which extends transversely through the upper interface 22 of the sight receiver 10 and can be seen to extend along one edge of the mounting slot 26. The mounting pin 30 is a generally round structure with a portion of its central region milled away to form a D-shaped profile having one flat side 42. With the actuator arm 32 in the position shown, the mounting pin 30 is positioned so that the flat side 42 of the mounting pin 30 is facing the mounting slot 26. The flat side 42 effectively removes the mounting pin 30 as an obstruction to the mounting slot 26 thereby allowing the lug 36 on the mounting ring 12 to be installed or removed from the mounting slot 26.

In FIG. 4, the mounting ring 12 and auxiliary sight 38 are shown in an installed position mated with the upper interface 22 of the sight receiver 10. The lug 36 is shown received within the mounting slot 26 and the actuator arm 32 is rotated into an engaged position as indicated by arrow 44. As can best be seen in FIGS. 4*a* and 4*b* when the actuator arm 32 is rotated into the engaged position the mounting pin 30 is rotated so that the machined portion of the mounting pin 30 having the flat side 42 faces away from the mounting slot 26 and the round side 46 of the D-shaped mounting pin 30 extends beyond the edge of the mounting slot 26 and encroaches on the area within the mounting slot 26. The lug 36 on the mounting ring 12 is provided with a cut away region or detent 48 in the side thereof that corresponds to the size, shape and position of the mounting pin 30 when the lug 36 is received within the mounting slot 26 so that when the mounting pin 30 is rotated, it engages the detent 48 in the lug 36 firmly retaining the mounting ring 12 in an engaged position relative to the mounting base 10. An interlock member 50 can also be seen disposed above the actuator arm 32. The interlock member 50 is preferably a spring biased pin that extends out from the side of the sight receiver 10 and serves as a safety to prevent accidental rotation of the actuator arm 32. When the actuator arm 32 is in the engaged position, the interlock member 50 extends outwardly over the actuator arm 32 preventing accidental rotation of the actuator arm 32. In order to rotate the actuator arm 32, the interlock member 50 must first be depressed, therefore allowing the actuator arm 32 to rotate out of the engaged position and allow removal of the mounting ring 12 and the auxiliary sight 38 from the sight receiver 10. This is a particularly useful feature when the mounting system is to be utilized in combat situations where it is critical that the sight be reliably and positively engaged.

While this locking mechanism for engaging the mounting ring 12 with the sight receiver 10 is described as having specific D-shaped mounting pin 30 structure, any appropriate component could be substituted in place of the D-shaped mounting pin 30 and remain within the scope of the present invention. The novelty of the present invention resides in the fact that rotation of the mounting pin 30 serves to engage a detent 48 in a lug 36 on the mounting ring 12 and prevent removal of the mounting ring 12 from the sight receiver 10. To the extent that a wedge shaped mounting pin 30, offset region on the mounting pin 30 or any other geometric arrangement of the mounting pin 30 accomplishes this stated goal, it is intended to fall within the scope of the present invention.

Figure 5:
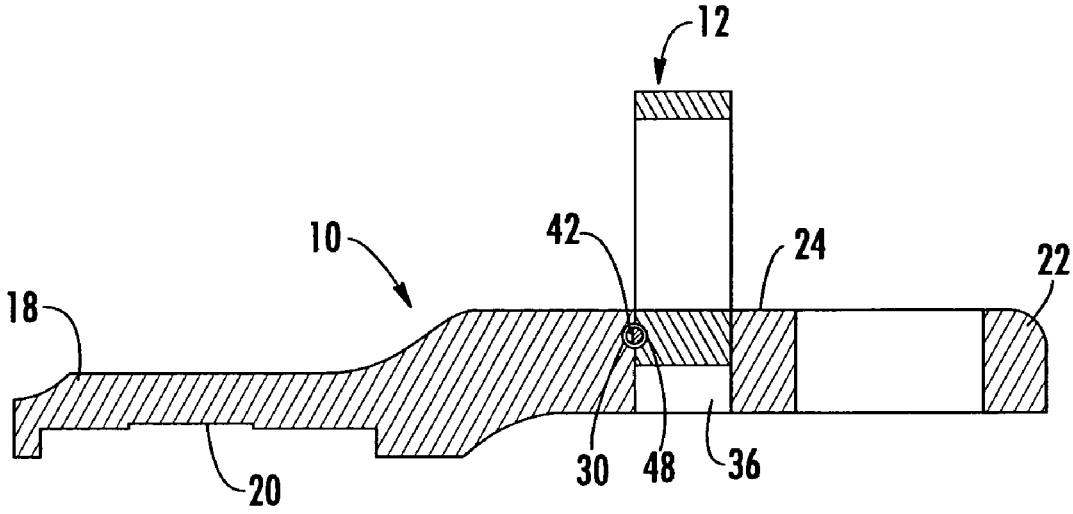
FIG. 5 is a cross sectional view of the sight mounting system of the present invention, taken along line 5—5 in FIG. 1, with the retaining member in an engaged position.

The positively aligning feature of the present invention in the context of the relationship between the mounting ring 12 and the sight receiver 10 is best illustrated in FIG. 5. The mounting ring 12 is shown in an installed position with the lug 36 received within the mounting slot 26 in the sight receiver 10. The lug 36 extends into the mounting slot 26 and the mounting pin 30 is rotated in a manner that causes the round side 46 of the mounting pin 30 to engage the detent 48 in the lug 36 on the mounting ring 12. The tolerance between the dimensions of the mounting slot 26 and the lug 36 are machined to be closely matched wherein the mounting lug 36 can easily be installed or removed from the mounting slot 26 without binding but when the lug 36 is in the engaged position, it cannot move relative to the sight receiver 10. The tolerances for dimensioning between the mounting lug 36 and the walls of the mounting slot 26 are preferably within 0.002". Additionally, as stated above, adjacent the mounting slot 26, an alignment channel 28 is provided that is formed as a concentric shoulder area wherein the walls of the alignment channel 28 engage a portion of the mounting ring 12 itself. This engagement provides additional contact surface to ensure proper and consistent alignment of the auxiliary sight 38 relative to the sight receiver 10 and with the firearm even if the auxiliary sight 38 is removed and reinstalled several times. Further, the alignment channel 28 adds stability and resistance against rotation if rotational force is accidentally applied to the auxiliary sight 38 and/or the mounting ring 12. It is the repeatability and reliability of the relative alignment between the auxiliary sight 38, the mounting ring 12, the sight receiver 10 and the firearm that provides a dramatic improvement of the present invention over the prior art. It is specifically this construction that allows the auxiliary sight 38 to be removed and reinstalled to and from the firearm without introducing sight alignment errors that may have fatal consequences.

The assembly of the present invention also introduces a modular system wherein several different auxiliary sighting devices 38 can each be fitted with a mounting ring 12 or at least the necessary structure to engage in the mounting slot 26 and alignment channel 28. Each of these devices can be calibrated and then removed from the firearm and stored. This allows the user of the firearm to quickly select the required auxiliary sighting device 38 that is best suited for the application at hand and install it onto the firearm while having the confidence that once engaged with the sight receiver 10, the sighting device 38 will be positively and reliably aligned in the correct relation to the firearm.

Figure 6:
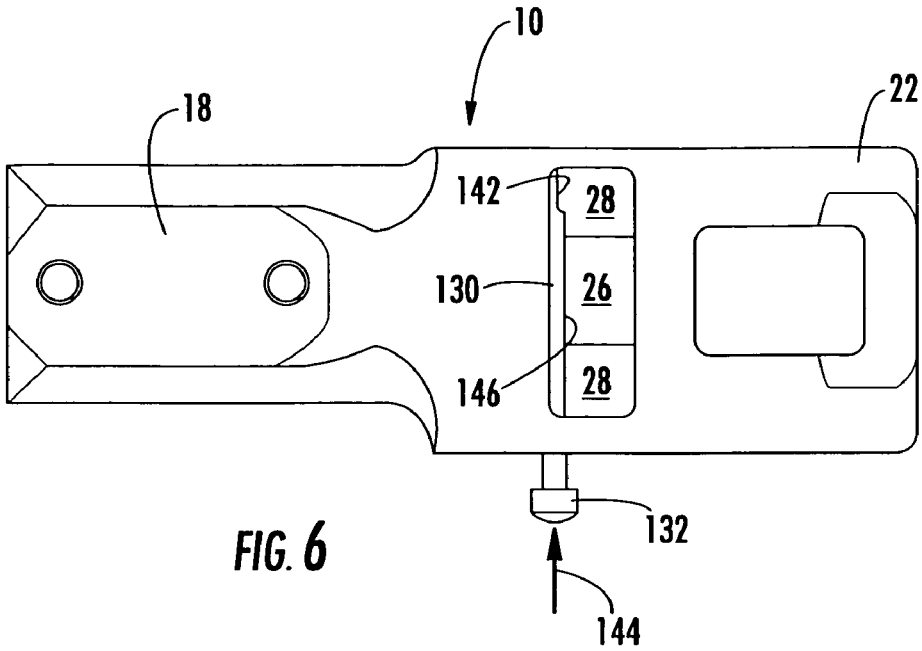
FIG. 6 is a top view of the sight mounting system of the present invention, with an alternate embodiment retaining member in an engaged position, the mounting ring and sight are removed for clarity.
Figure 6A:
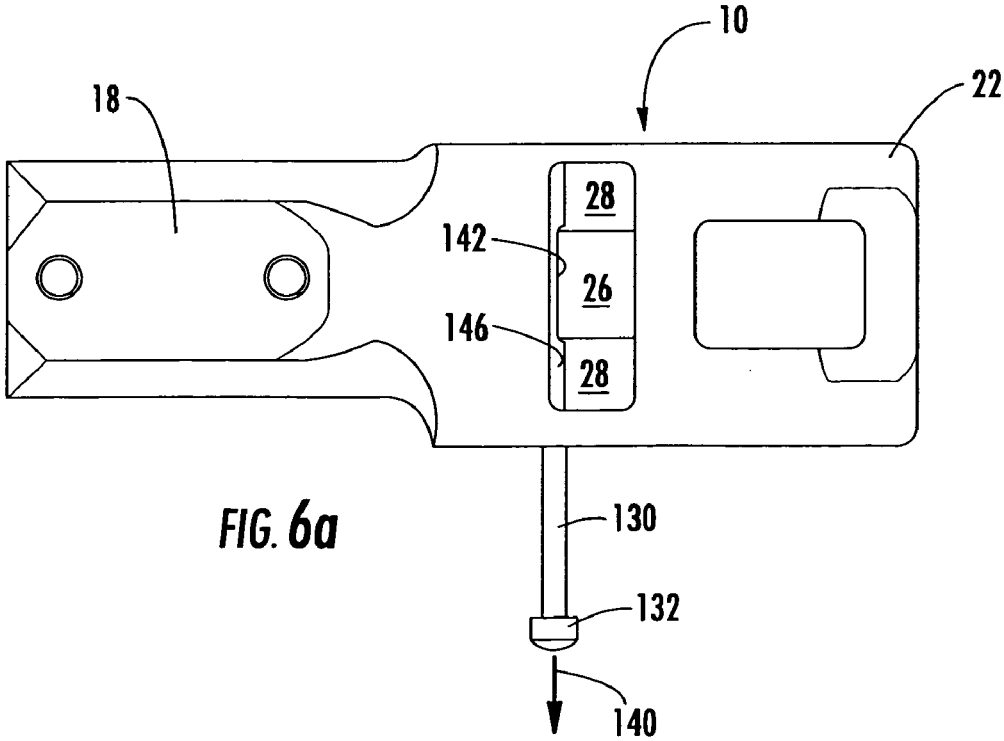
FIG. 6*a* is a top view of the sight mounting system of the present invention, with an alternate embodiment retaining member in a disengaged position, the mounting ring and sight are removed for clarity.

An alternate embodiment of the locking mechanism is shown in FIGS. 6 and 6*a*. In this embodiment the mounting pin 130 is shown as being slidable relative to the upper interface 22. With the mounting pin moved into the engaged position in accordance with arrow 144, it can be seen that the machined portion of the mounting pin 130 positions the flat side 142 in a location that is beyond the mounting slot 26 and the round portion 146 is located across the side of the mounting slot 26 and encroaches on the area within the mounting slot 26. The lug 36 on the mounting ring 12 is provided with a cut away region or detent 48 in the side thereof that corresponds to the size, shape and position of the mounting pin 130 when the lug 36 is received within the mounting slot 26 so that when the mounting pin 130 is slid into the engaged position, it engages the detent 48 in the lug 36 firmly retaining the mounting ring 12 in an engaged position relative to the mounting base 10. When the mounting pin 130 is partially withdrawn from the mounting base 10 in accordance with arrow 140, the flat face 142 of the mounting pin 130 is positioned adjacent the mounting slot 26 thereby clearing the mounting pin 130 and preventing it from obstruction the withdrawal of the mounting ring 12. It is important to note that while two specific configurations depicting movement and geometry for a mounting pin 30, 130 have been depicted herein, these descriptions are meant to be illustrative and not limiting. The general concept of the present invention is simply to provide a mounting pin that can be displaced between an engaged and disengaged position to retain or release the mounting ring 12 relative to the mounting base 10.

Figure 7:
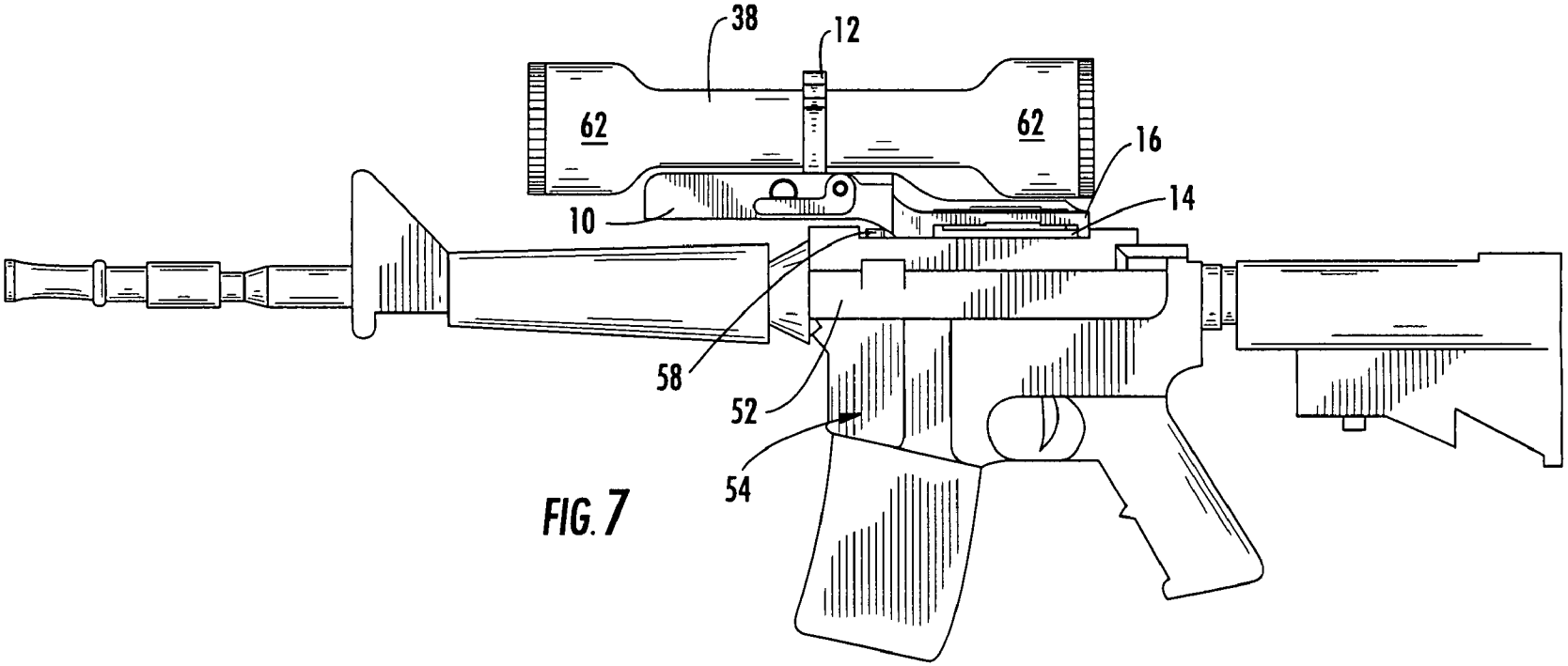
FIG. 7 is a side view of the sight mounting system of the present invention, installed onto the upper receiver of a firearm.

The assembly of the present invention is configured to be mounted onto an upper receiver 52 of a firearm 54 as is shown in FIG. 7. The sight receiver 10 is attached to the upper receiver 52 of the firearm 54 utilizing a firearm interface 14. In one embodiment, the sight receiver 10 may be mounted to the upper receiver 52 of the firearm 54 simply by utilizing a firearm interface 14 such as screw fasteners to attach the lower interface 18 of the sight receiver 10 directly and rigidly onto the upper receiver 52 of the firearm 54. In the preferred embodiment, the sight receiver 10 is used in conjunction with a firearm interface 14 such as the one shown in FIGS. 1 and 2. This firearm interface 14 is a clamp member that is rigidly attached to the lower surface 20 of the lower interface 18 utilizing fasteners such as screws 56. Once the firearm interface 14 is assembled onto the sight receiver 10, the firearm interface 14 then is mounted to a mounting rail 58 that is either connected directly to the upper receiver 52 of the firearm 54 or is a component part of a receiver/barrel guard sleeve system. The firearm interface 14 includes a gripping clamp 60 that engages the sides of the firearm mounting rail 58 to firmly hold the firearm interface 14 and the sight receiver 10 attached thereto on the upper receiver 54 and mounting rail 58 on the firearm 54. The firearm interface 14 can be selectively operated to allow the sight mount of the present invention to be positioned in any location along the receiver interface rail 58 and/or barrel of the firearm 54 thereby providing for a large degree of longitudinal adjustment and positioning of the auxiliary sighting device 38. The clamping mechanism 60 in the firearm interface 14 is operated by a single thumb lever and a cam lock assembly making removal and/or adjustment easy.

As stated above, spacer blocks 16 may also be included between the firearm interface 14 and the lower surface 20 of the lower interface 18. The spacer blocks 16 serve to adjust the spacing between the sight receiver 10 and the firearm 54 in order to accommodate a sighting element 38 that has large bell elements 62 on the ends thereof or to position the sighting element 38 in a manner that makes it comfortable for the user of the device. Also, in this manner, the system can be configured to accommodate a variety of sight devices 38 as well as to allow the sight device 38 to be positioned to avoid conflict with other accessories that may be mounted on the firearm 54.

It can therefore be seen that the present invention provides a positively aligning, quick mount assembly for interfacing an auxiliary sighting device 38 such as an optical scope with a firearm 54. The mounting assembly allows quick and easy mounting, removal and re-mounting of auxiliary sights 38 on any firearm 54 while eliminating the need to re-adjust or zero the scope when it is replaced in its mounted position on the firearm 54. The present invention is particularly suited for use in the modern type sporting and/or combat rifle and is particularly flexible and customizable for a variety of applications. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. An assembly for mounting a firearm sighting device comprising:

a sight receiver having an upper interface and a lower interface, said upper interface having a mounting slot formed in an upper surface thereof and a rotatable pin extending through said upper interface adjacent said mounting slot, said pin having a flattened central region;

a mounting ring, said mounting ring configured to receive and retain a sighting device, said mounting ring having a mounting lug extending therefrom, said mounting lug having a detent formed in a side thereof; and a firearm interface including an upper portion configured and arranged to engage said lower interface of said sight receiver and a lower portion formed as a modular clamping assembly for releasably attaching said sight receiver to said firearm, wherein said mounting lug is configured to be received into said mounting slot in said sight receiver when said rotatable pin is in a first disengaged position with said flattened central region positioned substantially coplanar with a side wall of said mounting slot, said rotatable pin engaging said detent in said mounting lug when said rotatable pin is rotated into a second engaged position said central region extending at least partially into said mounting slot and engaging said detent in said mounting lug, thereby preventing said mounting ring from being withdrawn from said sight receiver, said mounting ring being engaged in substantial alignment with said sight receiver.

2. The assembly for mounting a firearm sighting device of claim 1, said rotatable pin further comprising:

an actuator coupled to an end of said rotatable pin.

3. The assembly for mounting a firearm sighting device of claim 2, said rotatable pin further comprising:

a safety stop extending from said upper interface adjacent said actuator, said safety stop being movable between a first position wherein said safety stop prevents said actuator from being moved from said engaged position and a second position wherein said actuator can be moved.

4. The assembly for mounting a firearm sighting device of claim 1, wherein said clamping assembly is configured to interface directly with an upper receiver of said firearm.

5. The assembly for mounting a firearm sighting device of claim 1, wherein said clamping assembly is configured to interface with a rail system mounted on said firearm.

6. The assembly for mounting a firearm sighting device of claim 1, wherein said firearm interface is formed integrally with said lower interface of said sight receiver.

7. The assembly for mounting a firearm sighting device of claim 1, further comprising at least one spacer block fastened between said lower surface of said lower interface and said firearm interface.

8. An assembly for mounting a firearm sighting device comprising:

a sight receiver having an upper interface and a lower interface, said upper interface having a mounting slot formed in an upper surface thereof and a slidable pin extending through said upper interface adjacent said mounting slot, said pin having a proximal region and a distal region, said distal region having a flattened profile;

a mounting ring, said mounting ring configured to receive and retain a sighting device, said mounting ring having a mounting lug extending therefrom, said mounting lug having a detent formed in a side thereof; and a firearm interface including an upper portion configured and arranged to engage said lower interface of said sight receiver and a lower portion configured and arranged as a clamping assembly for releasably attaching said sight receiver to said firearm, wherein said mounting lug is configured to be received into said mounting slot in said sight receiver when said slidable pin is partially slid outwardly from said upper interface into a first disengaged position with said flattened region positioned to remain substantially co-planar with a side wall of said mounting slot, said proximal region configured to extend at least partially into said mounting slot and engaging said detent in said mounting lug when said slidable pin is slid into said upper interface into a second engaged position thereby preventing said mounting ring from being withdrawn from said sight receiver, said mounting ring being engaged in substantial alignment with said sight receiver.

9. The assembly for mounting a firearm sighting device of claim 8, said locking mechanism further comprising:

a safety stop extending from said upper interface adjacent said slidable pin, said safety stop being movable between a first position wherein said safety stop prevents said slidable pin from being moved from said engaged position and a second position wherein said slidable pin can be moved.

10. An assembly for mounting a firearm sighting device comprising:

a sight receiver having an upper interface and a lower interface, said upper interface having a mounting slot formed therein, an alignment channel formed in an upper surface thereof, concentrically disposed around said mounting slot and a locking mechanism extending through said upper interface adjacent said mounting slot;

a mounting ring, said mounting ring configured to receive and retain a sighting device, said mounting ring having a mounting lug extending therefrom, said mounting lug having a detent formed in a side thereof; and a firearm interface configured and arranged to engage said lower interface of said sight receiver and attach said sight receiver to said firearm, wherein said mounting lug is configured to be received into said mounting slot in said sight receiver with a lower portion of said mounting ring being received into said alignment channel when said locking mechanism is in a first disengaged position, said locking mechanism engaging said detent in said mounting lug when said locking mechanism is displaced into a second engaged position thereby preventing said mounting ring from being withdrawn from said sight receiver, said alignment channel cooperating with mounting ring to maintain said mounting ring and a sighting device retained therein in substantial alignment with said sight receiver.

11. The assembly for mounting a firearm sighting device of claim 10, said locking mechanism further comprising:

a rotatable pin extending through said upper interface adjacent said mounting slot, said pin having a central region and first and second end regions adjacent said central region, said central region configured to remain substantially co-planar with a side wall of said mounting slot when said locking mechanism is rotated into said first disengaged position, said central region extending at least partially into said mounting slot and engaging said detent in said mounting lug when said locking mechanism is rotated into said second engaged position; and an actuator coupled to one of said first or second end regions of said rotatable pin.

12. The assembly for mounting a firearm sighting device of claim 11, said locking mechanism further comprising:

a safety stop extending from said upper interface adjacent said actuator, said safety stop being movable between a first position wherein said safety stop prevents said actuator from being moved from said engaged position and a second position wherein said actuator can be moved.

13. The assembly for mounting a firearm sighting device of claim 10, said locking mechanism further comprising:

a slidable pin extending through said upper interface adjacent said mounting slot, said pin having a proximal region and a distal region, said distal region configured to remain substantially co-planar with a side wall of said mounting slot when said locking mechanism is partially slid outwardly from said upper interface into said first disengaged position, said proximal region configured to extend at least partially into said mounting slot and engaging said detent in said mounting lug when said locking mechanism is slid into said upper interface into said second engaged position; and an actuator coupled to an end of said pin adjacent said proximal region.

14. The assembly for mounting a firearm sighting device of claim 13, said locking mechanism further comprising:

a safety stop extending from said upper interface adjacent said actuator, said safety stop being movable between a first position wherein said safety stop prevents said actuator from being moved from said engaged position and a second position wherein said actuator can be moved.

15. The assembly for mounting a firearm sighting device of claim 10, wherein said firearm interface is at least one screw configured to fasten said lower interface onto an upper receiver of said firearm.

16. The assembly for mounting a firearm sighting device of claim 10, wherein said firearm interface is clamping means to interface directly with an upper receiver of said firearm.

17. The assembly for mounting a firearm sighting device of claim 10, wherein said firearm interface is a clamping means to interface with a rail system mounted on said firearm.

18. The assembly for mounting a firearm sighting device of claim 10, wherein said firearm interface is formed integrally with said lower interface of said sight receiver.

19. The assembly for mounting a firearm sighting device of claim 10, further comprising at least one spacer block fastened between said lower surface of said lower interface and said firearm interface.

* * * * *